US011135499B2

(12) United States Patent
Croft

(10) Patent No.: US 11,135,499 B2
(45) Date of Patent: Oct. 5, 2021

(54) CONVERTIBLE FITNESS BAG

(71) Applicant: Ellen Croft, Santa Barbara, CA (US)

(72) Inventor: Ellen Croft, Santa Barbara, CA (US)

(73) Assignee: Ellen Croft, Tarzana, CA (US)

( * ) Notice: Subject to any disclaimer, the term of this patent is extended or adjusted under 35 U.S.C. 154(b) by 0 days.

(21) Appl. No.: 15/775,107

(22) PCT Filed: Nov. 15, 2016

(86) PCT No.: PCT/US2016/062105
§ 371 (c)(1),
(2) Date: May 10, 2018

(87) PCT Pub. No.: WO2017/087423
PCT Pub. Date: May 26, 2017

(65) Prior Publication Data

US 2018/0353833 A1 Dec. 13, 2018

Related U.S. Application Data

(60) Provisional application No. 62/255,734, filed on Nov. 16, 2015.

(51) Int. Cl.

| | |
|---|---|
| ***A63B 1/00*** | (2006.01) |
| ***A63B 71/00*** | (2006.01) |
| ***A63B 21/02*** | (2006.01) |
| ***A63B 21/16*** | (2006.01) |
| ***A45F 4/02*** | (2006.01) |
| ***A45F 3/02*** | (2006.01) |

(Continued)

(52) U.S. Cl.
CPC ..... *A63B 71/0036* (2013.01); *A45F 3/02* (2013.01); *A45F 4/02* (2013.01); *A63B 21/023* (2013.01); *A63B 21/0442* (2013.01); *A63B 21/0552* (2013.01); *A63B 21/151* (2013.01); *A63B 21/1645* (2013.01); *A63B 21/4035* (2015.10); *A63B 21/0557* (2013.01); *A63B 2210/50* (2013.01)

(58) Field of Classification Search
None
See application file for complete search history.

(56) References Cited

U.S. PATENT DOCUMENTS 6,237,776 B1 * 5/2001 Mogil ..... A45C 3/00 150/106
6,367,674 B1 * 4/2002 Tabor ..... A45F 3/04 224/153

(Continued)

*Primary Examiner* — Megan Anderson

(57) ABSTRACT

A fitness apparatus is described which can be configured to operate both as a bag for carrying and storing exercise equipment and as a fixed anchor to which the exercise equipment can be connected. When operated as a bag, the apparatus can be filled with accessories and attachments that are utilized while performing exercises. These accessories can include, for example, Yoga Ropes, Pilates Springs, or Pulley Ropes. The fitness apparatus is converted to a fixed anchor by unzipping a zipper and turning the bag inside out, thereby exposing straps which are sewn onto the inside of the bag, and wrapping the straps around a door to provide fixed anchor points to which the accessories can be affixed. The straps which are wrapped around the door can be connected to one another on the opposite side of the door from the bag, thereby securing the apparatus to the door.

14 Claims, 6 Drawing Sheets

(51) Int. Cl.

| | |
|---|---|
| ***A63B 21/04*** | (2006.01) |
| ***A63B 21/055*** | (2006.01) |
| ***A63B 21/00*** | (2006.01) |

(56) References Cited

U.S. PATENT DOCUMENTS 6,386,414 B1 * 5/2002 Kilduff ..... A01K 1/0254 224/638
6,513,661 B1 * 2/2003 Mogil ..... A45C 3/00 150/106
8,074,853 B1 * 12/2011 Hirshberg ..... A45C 3/001 224/655
8,919,628 B2 * 12/2014 Jamlang ..... A45F 4/02 224/153
8,978,949 B2 * 3/2015 Arajakis ..... F41B 5/1457 224/153
9,241,557 B2 * 1/2016 Abramowitz ..... A45C 13/03
9,833,050 B1 * 12/2017 Pellegrino ..... A45C 11/00
2009/0075787 A1 * 3/2009 Hetrick ..... A63B 21/1663 482/91
2010/0048363 A1 * 2/2010 Gilberti ..... A63B 21/0603 482/105
2010/0224294 A1 * 9/2010 Svenson ..... A45C 3/001 150/103
2011/0287906 A1 * 11/2011 Morris ..... A63B 7/00 482/102
2016/0121157 A1 * 5/2016 Belmore ..... A63B 21/075 482/106
2016/0129292 A1 * 5/2016 Stroup ..... A63B 21/00065 482/93
2018/0050253 A1 * 2/2018 Magrino ..... A63B 69/20
2018/0154203 A1 * 6/2018 Schromm ..... A45F 3/04
2019/0217177 A1 * 7/2019 Magrino ..... A63B 21/0084

* cited by examiner

CONVERTIBLE FITNESS BAG

CROSS-REFERENCE TO RELATED APPLICATIONS

This application is a continuation of PCT/US2016/062105, filed Nov. 15, 2016, which claims the benefit of priority to U.S. Provisional Patent Application Ser. No. 62/255,734, filed on Nov. 16, 2015, the contents of each of which are incorporated by reference in their entirety.

TECHNICAL FIELD

This specification relates to fitness equipment, and specifically to bags that convert into anchoring devices for exercise equipment.

BACKGROUND

Many types of fitness and exercise techniques, including yoga, pilates, and resistance training, often require equipment such as ropes, springs, or pulley systems affixed to a supporting structure in order to allow a practitioner to perform many of the exercises and poses associated with the technique. Because these techniques are often practiced indoors, it is desirable to provide a portable apparatus that can provide a fixed anchor point to which equipment can be affixed in a typical indoor setting without modification or damage to walls, ceilings, doors, or other structural points.

DESCRIPTION OF THE DRAWINGS

Like reference symbols in the various drawings indicate like elements.

DETAILED DESCRIPTION

Described herein is a fitness apparatus configured to operate in a first mode of operation (herein referred to as "Carry Mode") as a bag for carrying and storing exercise equipment and to operate in a second mode of operation (herein referred to as "Fitness Mode") as a fixed anchor to which the exercise equipment can be connected. When the fitness apparatus is in Carry Mode, it operates as a storage and transport device (i.e., a bag) which can be filled with accessories and attachments that are attached and utilized during Fitness Mode. These accessories can include, for example, Yoga Ropes, Pilates Springs, or Pulley Ropes. The fitness apparatus is converted from Carry Mode to Fitness Mode by unzipping a reversible zipper and turning the bag inside out, thereby exposing straps/webbing which are sewn onto the inside of the bag, and wrapping the straps/webbing around a door to provide one or more fixed anchor points to which the attachments/accessories can be affixed. The straps which are wrapped around the door can be connected to one another on the opposite side of the door from the bag, for example by clipping then together using clips that are sewn into the straps.

Figure 1:
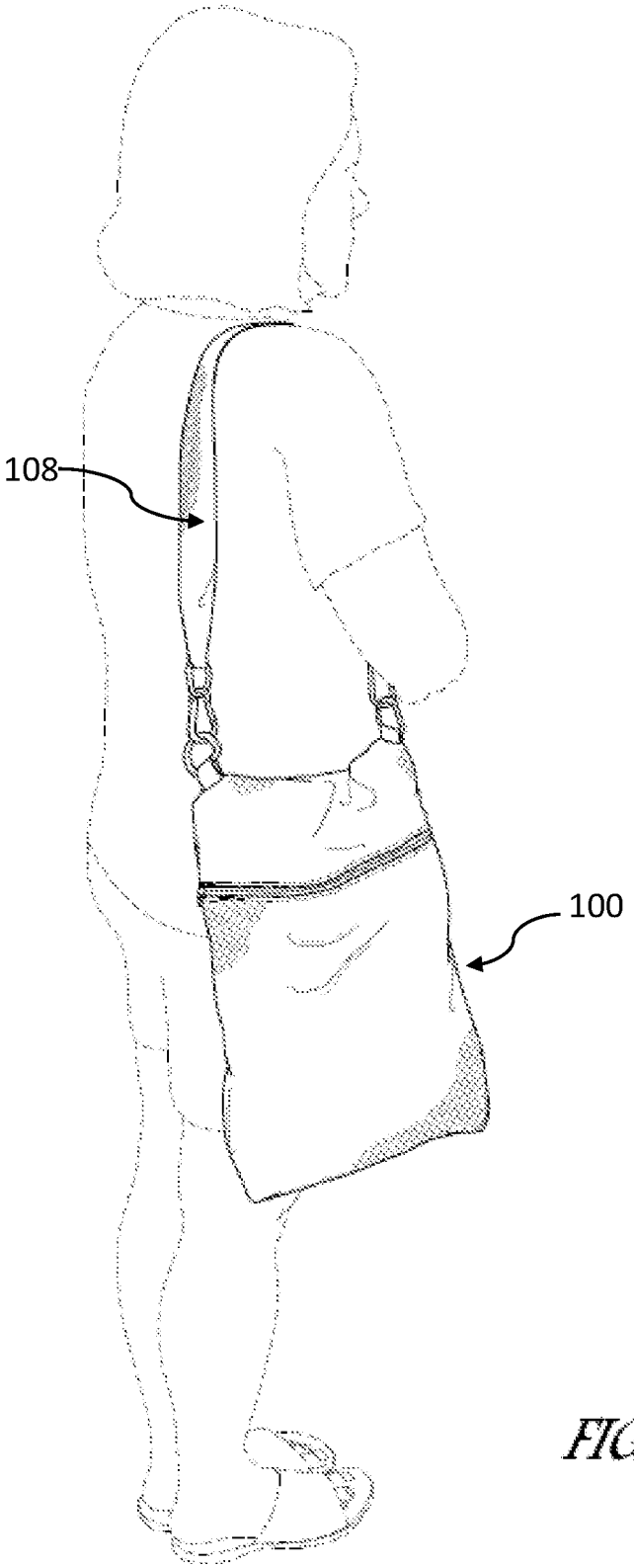
FIGS. 1-2 are views of a fitness apparatus configured in Carry Mode.
Figure 2:
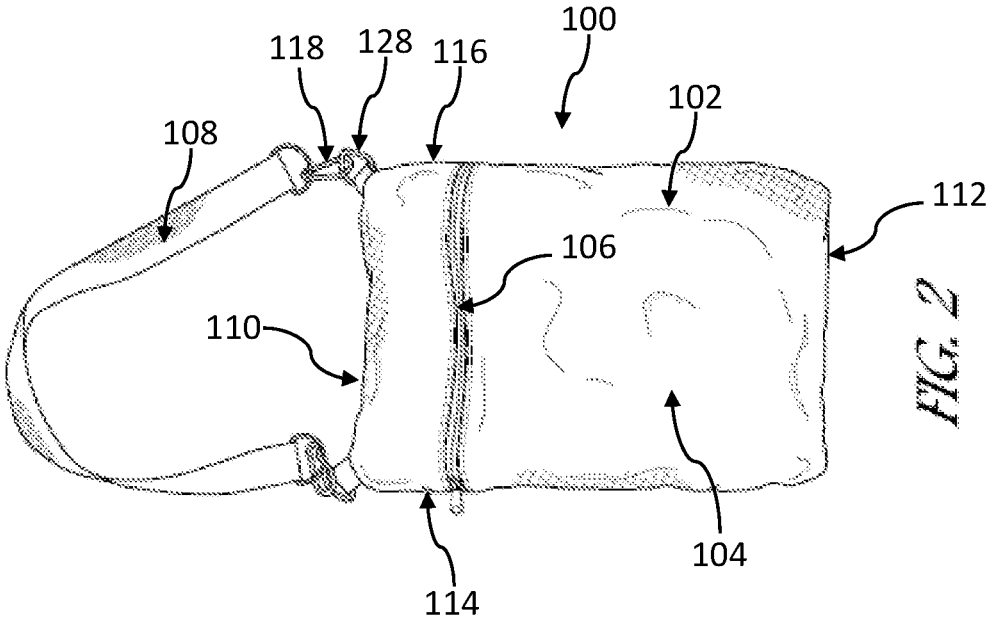

FIGS. 1 and 2 illustrate the fitness apparatus 100 while it is in Carry Mode. The fitness apparatus, operated as a bag in Carry Mode, includes a reversible fabric portion 102 formed of a strong fabric material and having a first fabric surface 104 on the bag's exterior and a second fabric surface 404 (shown in FIGS. 4 and 5) on the bag's interior. The fabric portion has a top side 110, a bottom side 112, a first side 114 extending from the top side 110 to the bottom side 112, and a second side 116 opposite the first side 114 and extending from the top side 110 to the bottom side 112. The apparatus further includes a zipper 106 extending from the first side 114 of the fabric portion toward the second side 116. The zipper 106 is preferably a reversible zipper so that it may be easily opened and closed both when the fitness apparatus is in Carry Mode and when the fitness apparatus in Fitness Mode. As also seen in FIGS. 1 and 2, the fitness apparatus 100 can further include a shoulder strap 108 formed, for example, of a strong webbing. The shoulder strap 108 can, for example, be attached to the bag via clips 118 at either end of the shoulder strap 108 that are clipped into a pair of loops (e.g., D-loops) 128 which are sewn into the top corners of the bag.

Figure 3:
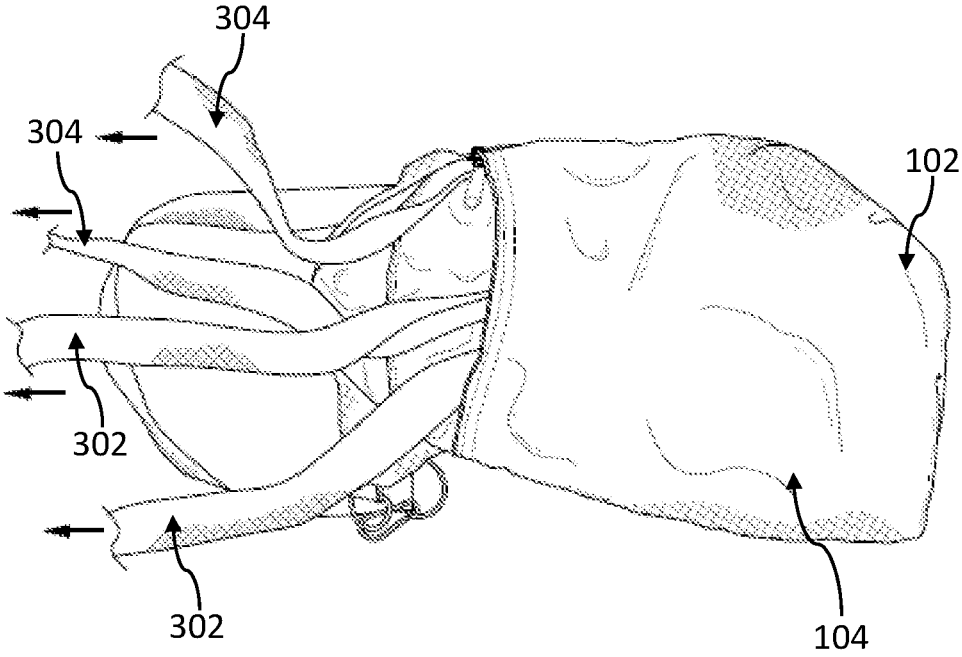
FIGS. 3-4 illustrate the fitness apparatus as it is converted from Carry Mode to Fitness Mode.
Figure 4:
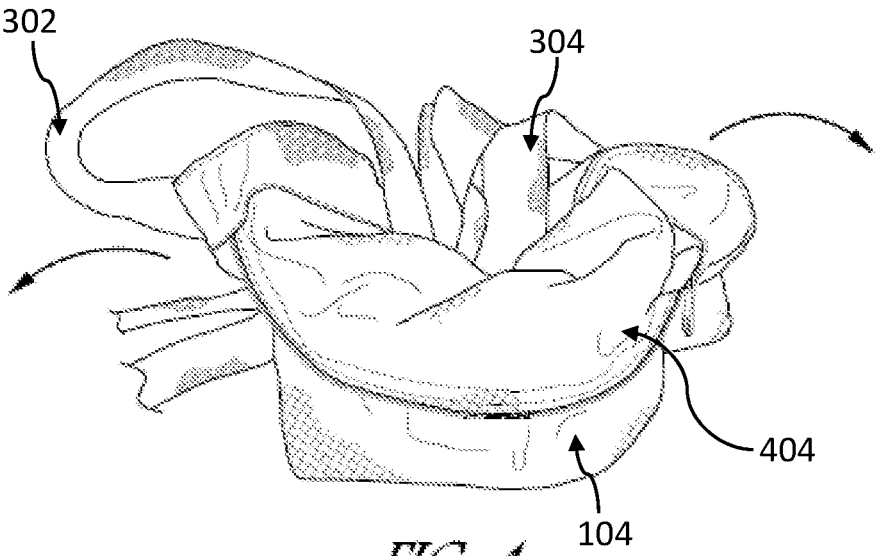
Figure 5:
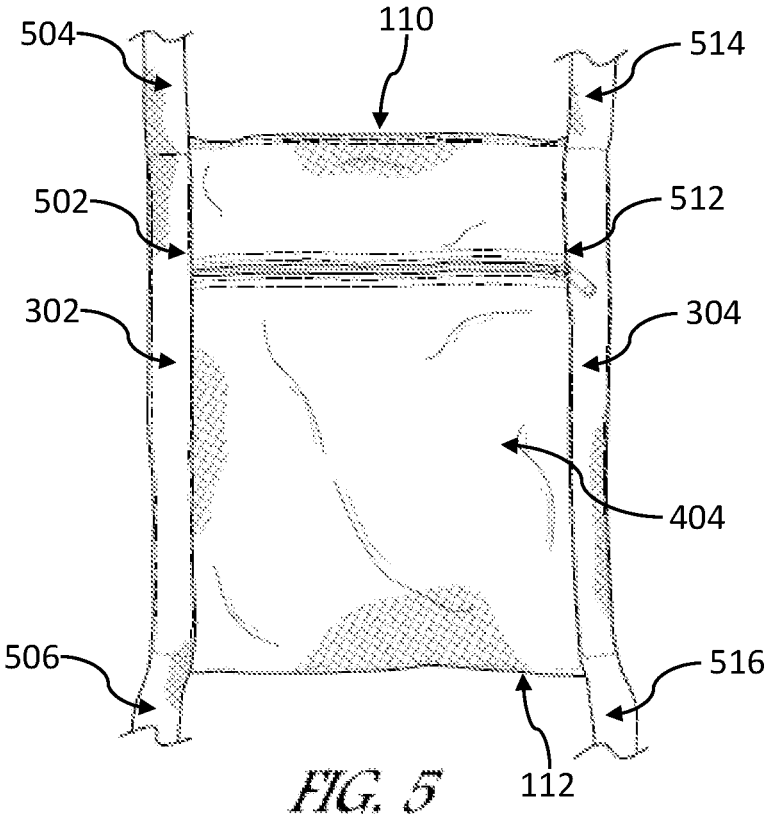
FIG. 5 is a view of a portion of the fitness apparatus while it is configured in Fitness Mode.
Figure 6:
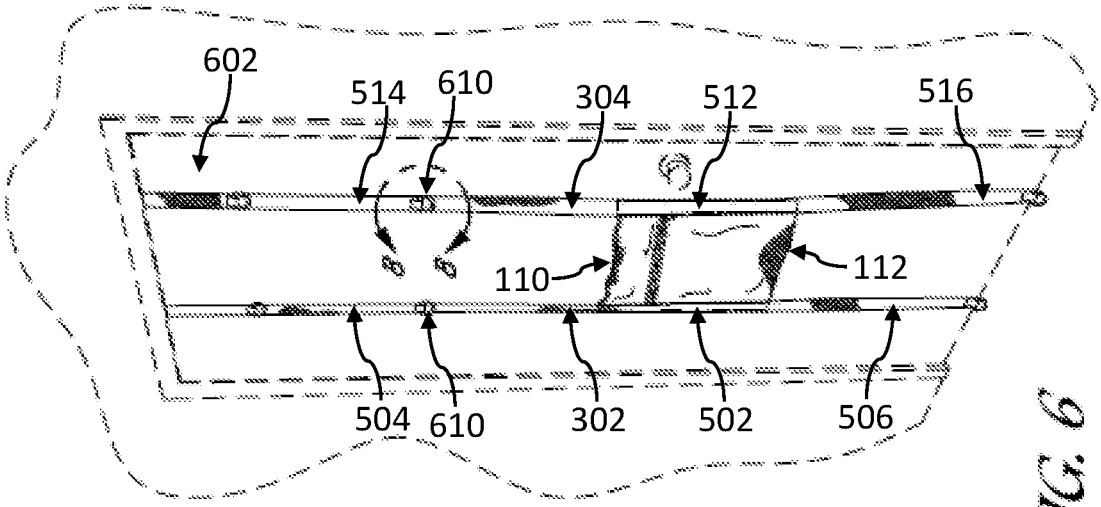
FIGS. 6 and 9-10 are views of the fitness apparatus affixed to a door while configured in Fitness Mode.

Referring to FIG. 3, the fitness apparatus further includes straps/webbing 302 and 304 which are sewn onto the inside of the bag. As seen in FIGS. 3-5, the fitness apparatus is converted from Carry Mode to Fitness Mode by opening the zipper to expose the straps/webbing 302 and 304 (FIGS. 3-4) and turning the bag inside out so that the straps/webbing 302 and 304 are on the outside (FIG. 5). As seen in FIGS. 5 and 6, strap 302 (i.e., the first strap) includes a first portion 502 affixed to the first side 114 of the fabric portion, a second portion 504 which extends above the top side 110 of the fabric portion while the fitness apparatus is configured in Fitness Mode, and a third portion 506 which extends below the bottom side 112 of the fabric portion while the fitness apparatus is configured in Fitness Mode. Similarly, strap 304 (i.e., the second strap) includes a first portion 512 affixed to the second side 116 of the fabric portion, a second portion 514 which extends above the top side 110 of the fabric portion while the fitness apparatus is configured in Fitness Mode, and a third portion 516 which extends below the bottom side 112 of the fabric portion while the fitness apparatus is configured in Fitness Mode.

Figure 10:
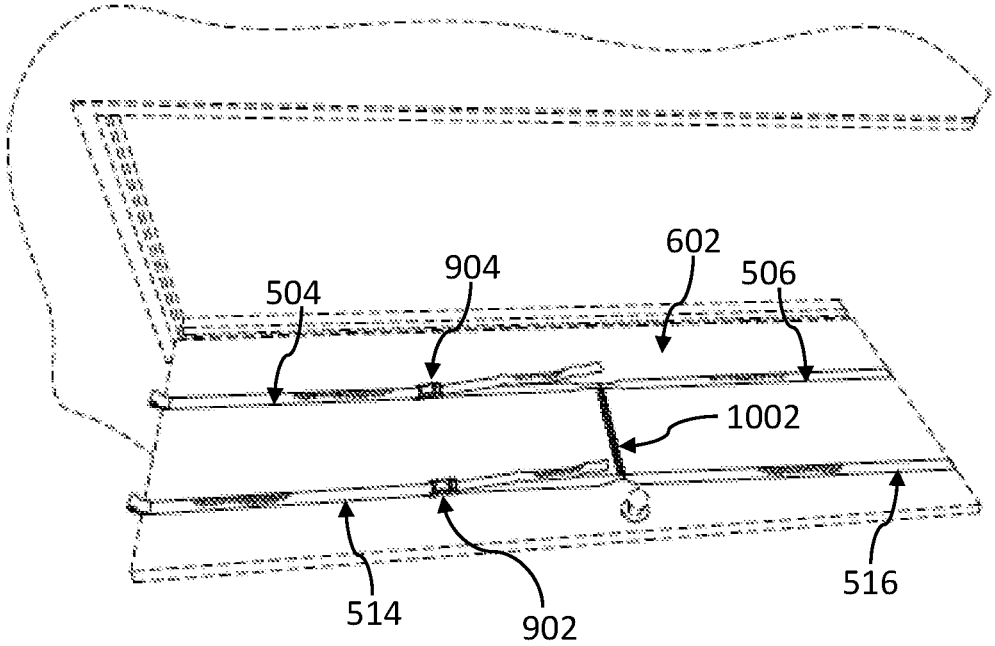
Figure 9:
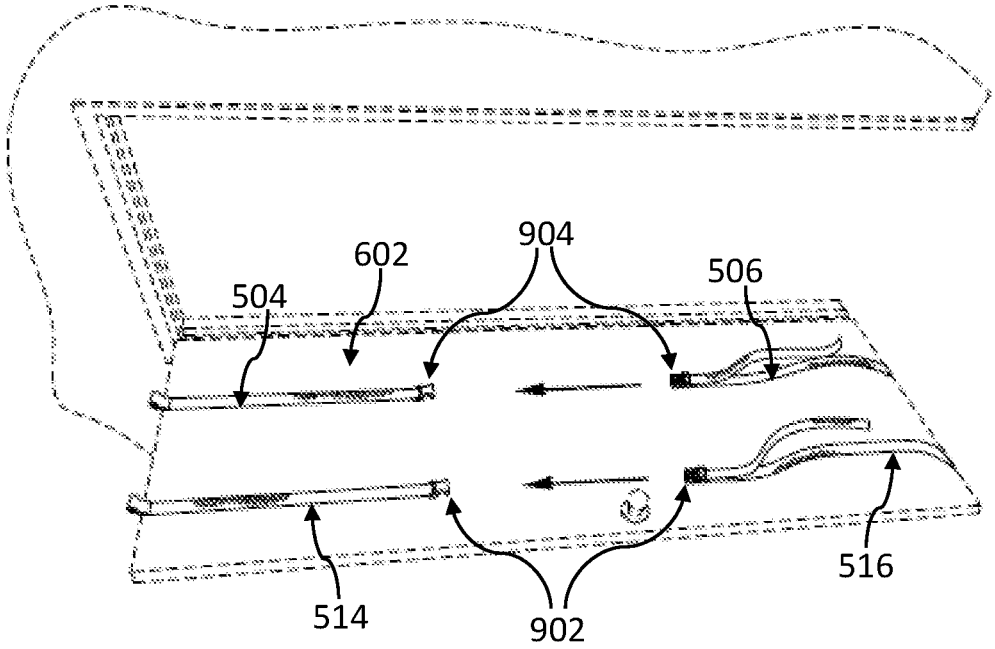
Figure 12:
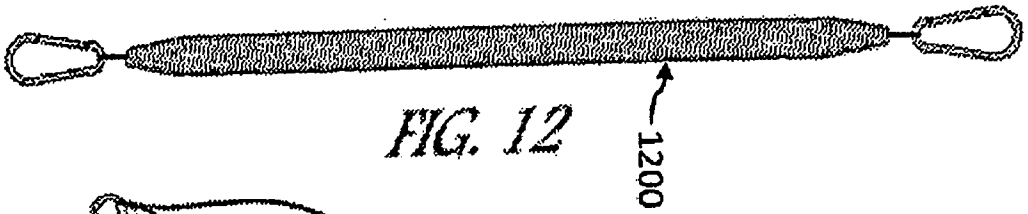
FIGS. 12-15 illustrate various attachments that can be affixed to anchor points on the fitness apparatus.
Figure 13:
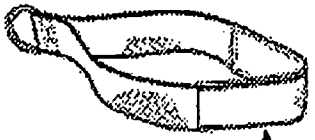
Figure 14:
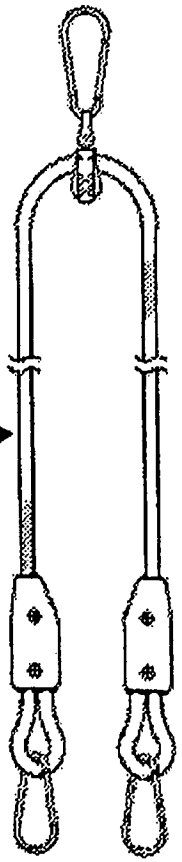
Figure 15:
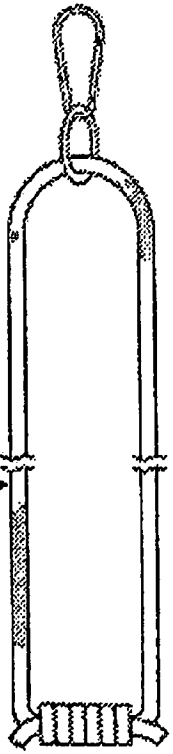

Still referring to FIG. 6, the fitness apparatus is configured to operate as a fixed anchor for exercise equipment while configured in Fitness Mode. In Fitness Mode, the first and second straps 302 and 304 are on the bag's exterior and are configured to each be wrapped around a fixed object such as a door 602. As seen in FIGS. 6 and 9-10, the second portions 504 and 514 of the first and second straps, respectively, are each configured to be wrapped over a top side of the door 602, and the third portions 506 and 516 of the first and second straps, respectively, are each configured to be wrapped over a bottom side of the door 602. As also seen in FIGS. 9-10, the second and third portions 504 and 506 of the first strap 302 are connected to one another on the opposite side of the door 602 from the bag by means of a first pair of connectors 902 on the second and third portions of the first strap, and the second and third portions 514 and 516 of the second strap 304 are connected to one another on the opposite side of the door 602 from the bag by means of a second pair of connectors 904 on the second and third portions of the second strap. Optionally, as shown in FIG. 10, the second and third straps 302 and 304, respectively, can be connected to one another on the opposite side of the door 602 from the bag by means of a securing strap 1002. The securing strap 1002 can provide additional support and rigidity to the fitness apparatus while it is secured to the door.

Figure 7:
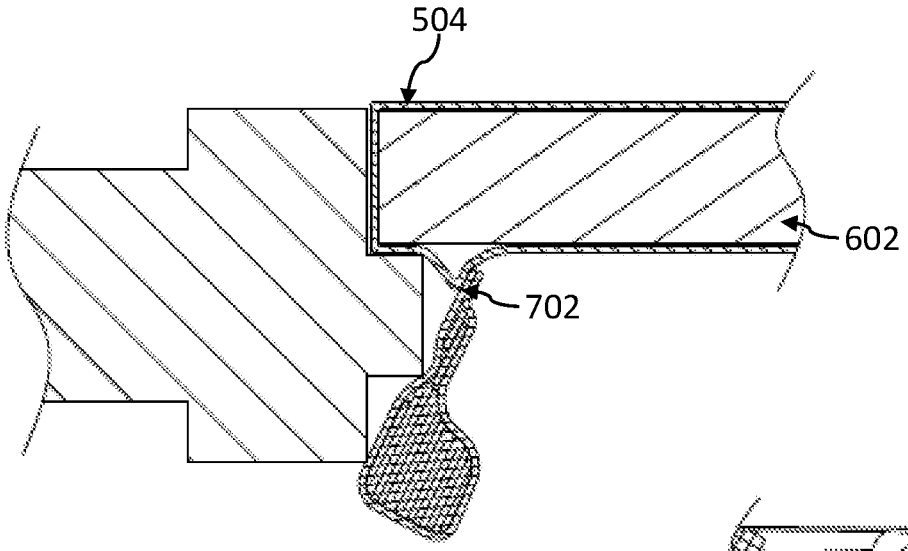
FIG. 7 is a cross-sectional view of a door showing straps of the fitness apparatus wrapped around the top of the door.

FIG. 7 is a cross-sectional view of the top of the door 602 illustrating the second portion 504 of the first strap 302 wrapped around the top of the door. As shown, the second portion 504 of the first strap 302 can include a stopper 702 positioned near the top of the door when the fitness apparatus is affixed to the door, the stopper 702 preventing the first strap from sliding around the door. Although not shown in the figures, the second portion 514 of the second strap 304 can also include a stopper 702 positioned near the top of the door when the fitness apparatus is affixed to the door, and the third portions 506 and 516 of the first and second straps 302 and 304, respectively, can each include stoppers 702 positioned near the bottom of the door when the fitness apparatus is affixed to the door. The stoppers can, for example, be regions of the first or second strap where the first or second strap is folded over itself to create a stop, as illustrated in FIG. 7. Such a stopper causes the strap to be too thick in the stopper region to slide through the crack between the door and the door jamb while the door is closed, thereby preventing the strap from sliding around the door while exercises are being performed.

Figure 8:
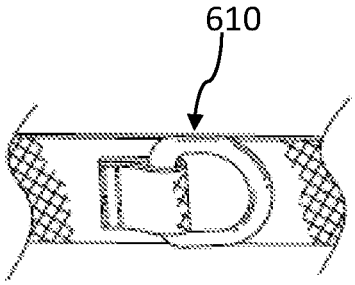
FIG. 8 illustrates an anchor point on the fitness apparatus.

As further seen in FIG. 6, an anchor point 610 is connected to the second portion 514 of the second strap 304. The anchor point 610 can, for example, be a steel D hook which is sewn into the strap, as illustrated in FIG. 8. Additional anchor points can be connected to the second portion 514 of the second strap 304, as well as to the second portion 504 of the first strap 302, the third portion 506 of the first strap 302, and the third portion 516 of the second strap 304. The anchors provide fixed attachment points at various places for attaching exercise equipment/accessories such as Pilates Springs, straps, Pulley Ropes, or Yoga Ropes.

FIGS. 12-15 illustrate various pieces of exercise equipment/accessories such as Pilates Springs (1200 in FIG. 12), straps (1300 in FIG. 13), Pulley Ropes (1400 in FIG. 14), or Yoga Ropes (1500 in FIG. 15) which can be connected to the anchor points while the fitness apparatus is affixed to the door. In this way, the fitness apparatus provides a portable framework to which exercise equipment/accessories can be attached and used to perform a variety of exercises.

Figure 11:
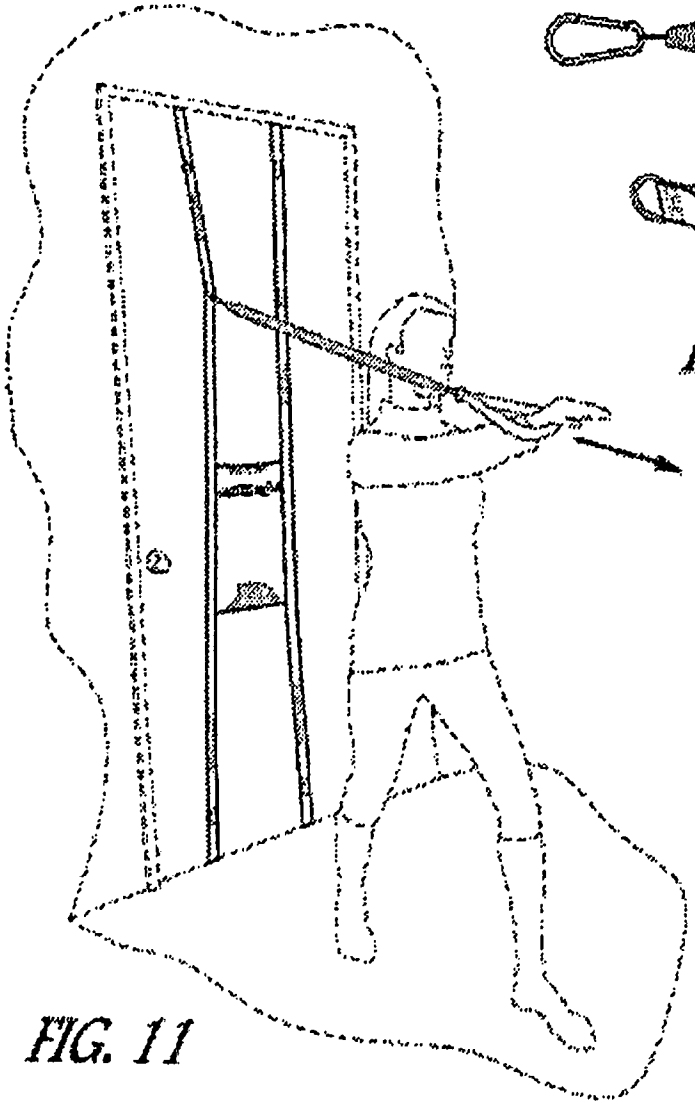
FIG. 11 illustrates an exerciser performing exercises using the fitness apparatus configured in Fitness Mode and affixed to a door.

FIG. 11 illustrates an exerciser performing exercises using the fitness apparatus configured in Fitness Mode. The exerciser may stand, sit, or lay down in front of the door, and by attaching the Pilates Springs, straps, Pulley Ropes, or Yoga Ropes to the anchor points attached to the straps, they now have a portable fitness machine which can be used to perform over 100 exercises.

In order to transport the fitness apparatus from one location to another, or to store the fitness apparatus in a compact location, the apparatus can be removed from the door and converted into Carry Mode by detaching the exercise equipment/accessories, reversing the bag, placing the exercise equipment/accessories inside the bag, and optionally closing the zipper.

A number of implementations have been described. Nevertheless, it will be understood that various modifications may be made without departing from the spirit and scope of the techniques and devices described herein. Accordingly, other implementations are within the scope of the following claims.

What is claimed is:

1. A fitness apparatus, comprising:

a bag including a fabric portion, the fabric portion having a first fabric surface on an exterior of the bag and a second fabric surface on an exterior of the bag while the fitness apparatus is in a first mode of operation and having the first fabric surface on the bag's interior and the second fabric surface on the bag's exterior while the fitness apparatus is in a second mode of operation, wherein the fabric portion has a top side, a bottom side, a first side extending from the top side to the bottom side, and a second side opposite the first side and extending from the top side to the bottom side;

a reversible zipper extending from the first side of the fabric portion toward the second side of the fabric portion;

a first strap having a first portion affixed to the first side of the fabric portion, a second portion which extends above the top side of the fabric portion while the fitness apparatus is in the second mode of operation, and a third portion which extends below the bottom side of the fabric portion while the fitness apparatus is in the second mode of operation;

a second strap having a first portion affixed to the second side of the fabric portion, a second portion which extends above the top side of the fabric portion while the fitness apparatus is in the second mode of operation, and a third portion which extends below the bottom side of the fabric portion while the fitness apparatus is in the second mode of operation;

a first pair of connectors on the second and third portions of the first strap, respectively, for connecting opposite sides of the first strap to one another while the fitness apparatus is configured in the second mode of operation;

a second pair of connectors on the second and third portions of the second strap, respectively, for connecting opposite sides of the second strap to one another while the fitness apparatus is configured in the second mode of operation; and an anchor point connected to the second portion of the first strap, the third portion of the first strap, the second portion of the second strap, or the third portion of the second strap; wherein the first and second straps are on the bag's interior during the first mode of operation; and the first and second straps are on the bag's exterior and are configured to each be wrapped around a fixed object during the second mode of operation.

2. The fitness apparatus of claim 1, wherein the fixed object is a door.

3. The fitness apparatus of claim 2, wherein the second portions of the first and second straps are each configured to be wrapped over a top side of the door, and the third portions of the first and second straps are each configured to be wrapped over a bottom side of the door.

4. The fitness apparatus of claim 3, further comprising stoppers on the second and third portions of each of the first and second straps, the stoppers configured to prevent the first and second straps from sliding around the door.

5. The fitness apparatus of claim 3, wherein the second and third portions of each of the first and second straps include stoppers which prevent the first and second straps from sliding around the door, the stoppers being regions of the first or second strap where the first or second strap is folded over itself to create a stop.

6. The fitness apparatus of claim 1, further comprising a pair of loops connected to a top side of the bag, the pair of loops being on the bag's exterior during the first mode of operation of the fitness apparatus and being on the bag's interior during the second mode of operation of the fitness apparatus.

7. The fitness apparatus of claim 6, wherein the pair of loops are configured to be connected to opposite ends of a carrying strap during the first mode of operation of the fitness apparatus.

8. The fitness apparatus of claim 1, wherein the fixed apparatus operates as a carrying and storage device while configured in the first mode of operation.

9. The fitness apparatus of claim 1, wherein the fitness apparatus operates as a fixed anchor for exercise equipment while configured in the second mode of operation.

10. The fitness apparatus of claim 1, wherein the anchor point is a first anchor point of a plurality of anchor points, wherein each of the plurality of anchor points is connected to the second portion of the first strap, the third portion of the first strap, the second portion of the second strap, or the third portion of the second strap.

11. A method of affixing exercise equipment to a door, comprising:

(a) providing a fitness apparatus, the fitness apparatus comprising:

a bag including a reversible fabric portion, the fabric portion having a first fabric surface on an exterior of the bag and a second fabric surface on an interior of the bag while the fitness apparatus is in a first mode of operation and having the first fabric surface on the bag's interior and the second fabric surface on the bag's exterior while the fitness apparatus is in a second mode of operation, wherein the fabric portion has a top side, a bottom side, a first side extending from the top side to the bottom side, and a second side opposite the first side and extending from the top side to the bottom side;

a reversible zipper extending from the first side of the fabric portion toward the second side of the fabric portion;

a first strap having a first portion affixed to the first side of the fabric portion, a second portion which extends above the top side of the fabric portion while the fitness apparatus is in the second mode of operation, and a third portion which extends below the bottom side of the fabric portion while the fitness apparatus is in the second mode of operation;

a second strap having a first portion affixed to the second side of the fabric portion, a second portion which extends above the top side of the fabric portion while the fitness apparatus is in the second mode of operation, and a third portion which extends below the bottom side of the fabric portion while the fitness apparatus is in the second mode of operation; and an anchor point connected to the second portion of the first strap, the third portion of the first strap, the second portion of the second strap, or the third portion of the second strap;

(b) wrapping the second portions of the first and second strap around a top side of the door and wrapping the third portions of the first and second strap around a bottom side of the door;

(c) connecting the second portion of the first strap to the third portion of the first strap via a first pair of connectors;

(d) connecting the second portion of the second strap to the third portion of the second strap via a second pair of connectors; and (e) connecting the exercise equipment to the anchor point.

12. The method of claim 11, wherein the fitness apparatus is configured to operate as both a carrying and storage device and as a fixed anchor for the exercise equipment.

13. The method of claim 11, wherein the fitness apparatus operates as a carrying and storage device while configured in the first mode of operation.

14. The method of claim 11, wherein the fitness apparatus operates as a fixed anchor for exercise equipment while configured in the second mode of operation.

* * * * *